United States Patent [19]

Whetstine

[11] 4,405,142

[45] Sep. 20, 1983

[54] KNOCK DOWN WHEEL CHAIR

[75] Inventor: Donald L. Whetstine, San Diego, Calif.

[73] Assignee: Stainless Medical Products, Inc., San Diego, Calif.

[21] Appl. No.: 241,750

[22] Filed: Mar. 9, 1981

[51] Int. Cl.[3] ..... A61G 5/02

[52] U.S. Cl. ..... 280/242 WC; 297/45; 297/431; 297/440; 297/DIG. 4; 411/21

[58] Field of Search ..... 280/242 WC, 242 R, 249, 280/289 WC; 180/DIG. 3; 297/DIG. 4, DIG. 6, 45, 430, 431, 432, 440, 443, 444; 403/DIG. 8; 411/21, 24, 25, 80

[56] References Cited

U.S. PATENT DOCUMENTS

| | | | |
|---|---|---|---|
| 2,782,835 | 2/1957 | Liebich | 297/DIG. 4 |
| 3,853,372 | 12/1974 | Meyer | 297/DIG. 4 X |
| 3,937,490 | 2/1976 | Nasr | 280/242 WC |
| 3,990,745 | 11/1976 | Rodaway | 297/DIG. 4 X |
| 3,993,351 | 11/1976 | Rodaway | 297/DIG. 4 X |
| 4,082,348 | 4/1978 | Haury | 297/45 |
| 4,227,742 | 10/1980 | Thomas | 297/430 |
| 4,351,540 | 9/1982 | Minnebraker | 280/242 WC |
| 4,358,125 | 11/1982 | Charles | 280/242 WC |
| 4,362,311 | 12/1982 | Bergman | 280/242 WC |

*Primary Examiner*—Joseph F. Peters, Jr.
*Assistant Examiner*—Mitchell J. Hill
*Attorney, Agent, or Firm*—Brown & Martin

[57] ABSTRACT

A knock down wheel chair that can be quickly disassembled and reassembled includes a pair of side frames connectable together by a front frame by means of quick release pins and by a back frame by means of quick release pins with a set of main wheels that are mounted to the respective side frames by means of quick release pins. The front frame assembly carries the front casters and is telescopically received in the side frames for adjusting the wheel base and is invertible to adjust the height of the frame with respective to the castors. The main wheels are detachably connectable to mounting plates on the side frames that are also adjustable for adjusting the width between the wheels and have means for adjusting the camber of the wheels as well as provide multiple different positions for height and center of gravity of the main wheels.

24 Claims, 7 Drawing Figures

Fig. 3
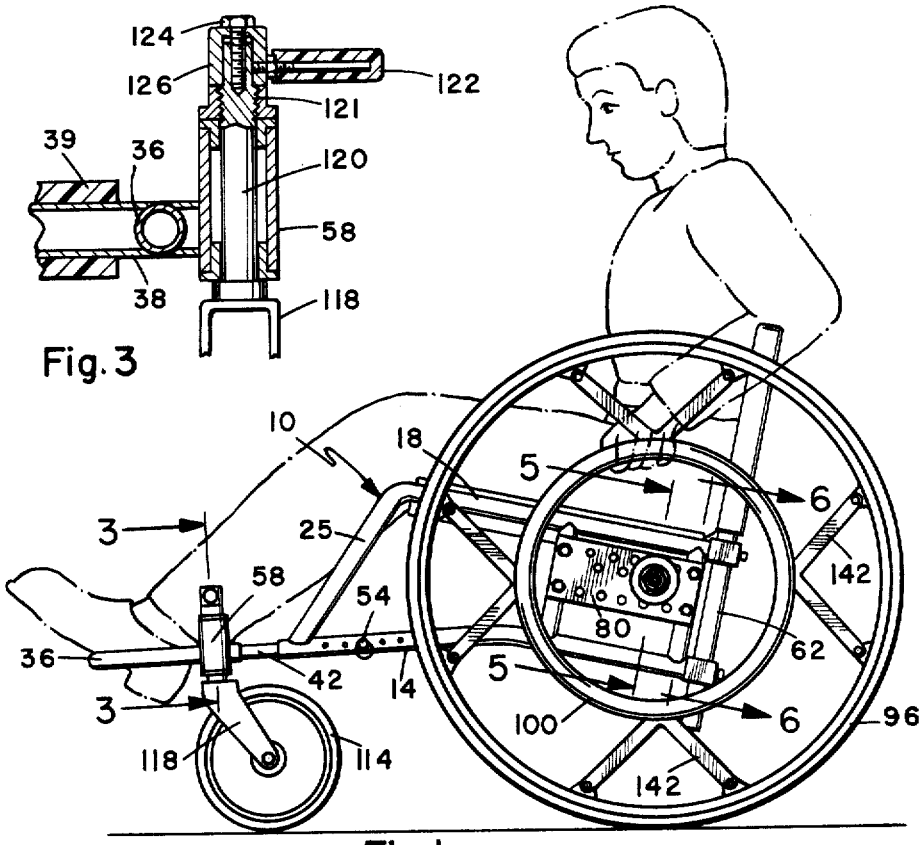
Fig. 1
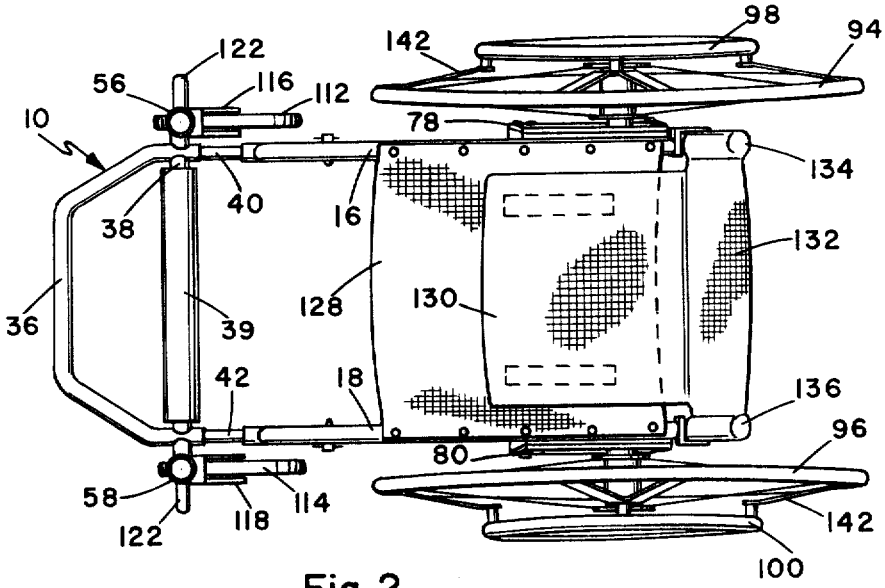
Fig. 2

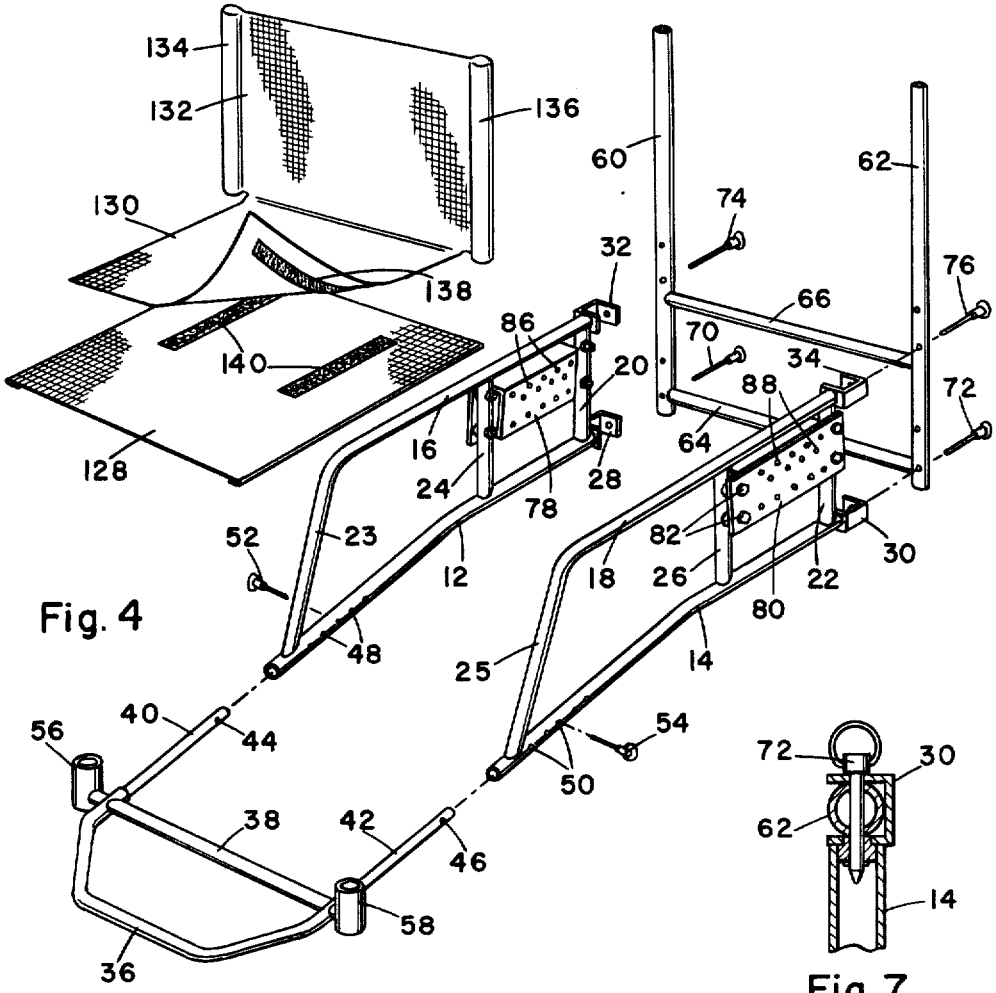
Fig. 4
Fig. 7
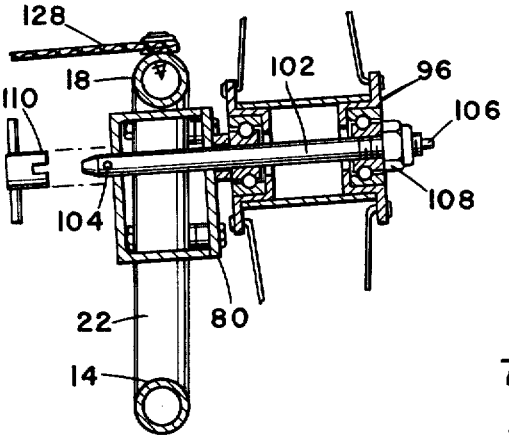
Fig. 5
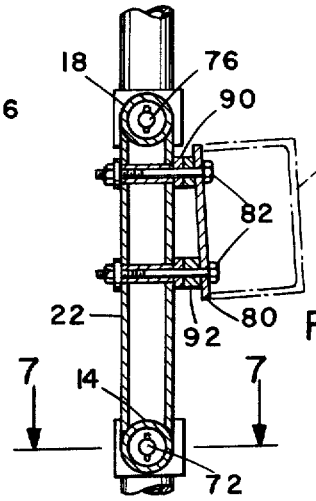
Fig. 6

KNOCK DOWN WHEEL CHAIR

BACKGROUND OF THE INVENTION

The present invention relates generally to wheel chairs and pertains particularly to a lightweight knock down chair. The portability of a wheel chair is a important consideration to many wheel chair bound persons today. It is desirable that a wheel chair be lightweight and easily broken down so that it can be readily and conveniently transported in an automobile or other suitable conveyance. Most wheel chairs today are foldable which permits them to be placed in the trunk or behind the front seat of an automobile. These chairs, however, are still unusually bulky and heavy and therefore, somewhat inconvenient to transport.

Another undesirable aspect of currently constructed wheel chairs is that they are unusually heavy and inhibit the rapid mobility of those wheel chair bound persons who desire to engage in sports. Many persons confined to wheel chairs desire to engage in sports activities such as basketball, racing and other sports. The commonly available wheel chair today inhibits such activity.

It is therefore desirable that a highly portable and mobile wheel chair be available for use in sports activities.

SUMMARY AND OBJECTS OF THE INVENTION

It is the primary object of the present invention to provide an improved wheel chair.

In accordance with the primary aspect of the present invention a wheel chair includes a quick knock down frame assembly connected together by quick release pins and quickly detachable wheels connected to the frame by quick detaching pins. Another aspect of the invention includes multiple length and height adjustments of the wheel chair assembly.

BRIEF DESCRIPTION OF THE DRAWINGS

The above and other objects and advantages of the present invention will become apparent from the following description when read in conjunction with the drawings wherein:

FIG. 1 is a side elevation view of the wheel chair of the present invention.

FIG. 2 is a top plan view of the embodiment of FIG. 1.

FIG. 3 is an enlarged sectional view taken on line 3—3 of FIG. 1. FIG. 4 is an exploded perspective view of the basic frame and C components.

FIG. 5 is an enlarged sectional view taken on line 5—5 of FIG. 1.

FIG. 6 is an enlarged sectional view taken on line 6—6 of FIG. 1.

FIG.7 is a sectional view taken on line 7—7 of FIG. 6.

DETAILED DESCRIPTION OF A PREFERRED EMBODIMENT

Turning to the drawings, there is illustrated a wheel chair in accordance with the invention which, as will be appreciated from viewing FIG. 1, is somewhat stretched out in comparison to currently available wheel chairs. The wheel chair of the present invention, designated generally by the numeral 10, is a knock down type construction having unique features which permit the chair to be quickly and rapidly knocked down and packaged in a compact easily transportable package or quickly and easily assembled for use. The chair also has features of adjustment which permit the wheel base to be selectively adjusted, the position of the rear wheels to be adjusted to multiple different positions for optimum positioning of the center of gravity and many other features as will be described.

As best illustrated, in FIG. 4, the basic frame assembly of the wheel chair comprises a pair of side frames which are basically mirror images of one other, with each including a lower tubular frame member 12 and 14 respectively, each of which is curved or bent slightly at the center thereof downward toward each end, and an upper tubular frame member 16 and 18. The upper tubular members each extend generally horizontally and parallel to the rear portion of the lower tubular members and are connected thereto by means of upright members 20 and 22 at the rear thereof, and 24 and 26 approximate the center thereof, with the forward ends 23 and 25 the center of the upper tubular members extending forward and downward to be connected to the forward ends of the lower tubular members 12 and 14. Each of the frame members include lower and upper C shaped brackets 28,30,32 and 34 fixed to the rear ends thereof and extending inward toward the opposite side frame.

The side frames are each connected together at the forward end by means of a front frame assembly or member having a generally A configuration and comprising a first tubular member curved forward and across to define a foot rest 36 at the forward edge thereof and curving around and back and connected by a cross bar member 38 serving as a leg support and a brace member. Cross member 38 may be covered with a resilient pad 39 on which the legs may rest at the rear of the ankles. Telescoping leg members 40 and 42 extend backward and telescopically extend into the lower tubular members 12 and 14 of the side frame members and include pin receiving bores 44 and 46 respectively therein for registering with a plurality of holes 48 and 50 in the lower side frame members 12 and 14, for receiving a pair of quick release pins 52 and 54. This provides a quick and simple assembly and disassembly of the frame members. The pull pins 52 and 54 are the type as would be described having ball type detents for holding the pin in position and permitting quick removal or insertion thereof.

The forward frame can be adjustably positioned longitudinal along the side frame members, thus providing a means for adjusting the length of the frame assembly and hence the wheel base of the wheel chair, as well as to permit the chair to accommodate persons of various height and length of legs. Similarly, the width of the frame can be selected by the width of the forward frame and the rear frame or back frame to be described.

The forward frame also includes castor bearing mounts 56 and 58 connected or secured at the outer ends of tubular member 38, which comprise vertical tubular members for receiving the rotatable bearing of the castor members as can be seen in FIGS. 1 and 2 for example. As will also be appreciated the castor mouonts 56 and 58 are mounted such that, in the illustrated position, the frame assembly is below the center of the length of these mounting members. This permits the frame to be turned over or inverted and the casters mounted so that the frame is higher above the wheels than in the previous mounting arrangement. This permits an adjustment of the front frame and ultimately the entire frame assembly higher with respect to the castor wheels.

Turning back to FIG. 4, a back frame assembly includes a pair of vertical tubular members 60 and 62 which are connected together at the lower end by means of a cross member 64 and an intermediate cross member 66. The back frame assembly is receivable within the C brackets 28, 30, and 34 include a plurality of holes registerable within the C brackets for receiving quick release pins 70, 72, 74 & 76. As will be seen, each of the members 60 and 62 which include a plurality of holes along the vertical length thereof for permitting an adjustment vertically of that frame assembly with respect to the side frame.

Each of the side frames includes a wheel mounting bracket 78 and 80 respectively detachably secured such as by a plurality of bolts 82 as illustrated to the vertical frame members 20–24 and 22–26 respectively. Each of the wheel brackets include a plurality of axle mounting bores 86 and 88 respectively. These permit the axle of the main wheels to be mounted in any selected one of the many bores along the upper or lower edge and thereby adjust the height of the frame as well as the center of gravity of the wheel chair assembly with respect to the main wheels.

The wheel brackets 78 and 80 are each of a generally box-like section which can be appreciated from viewing FIGS. 4, 5, and 6. As best seen in FIG. 6, a plurality of shims 90 and 92 may be selectively arranged on the upper and lower bolts holding the wheel bracket to the side frames members for selectively adjusting the tilt of the bracket with respect to the frame member, thereby adjusting the camber of the two main wheels. As will be appreciated addition of shims on the lower bolts holding the respective bracket to the frame member increases the camber. This camber is important in sports-type wheel chairs as it will be appreciated that the greater the camber the less the tendency of the wheel chair to tilt over from quick turns or from leaning to one or the other side thereof.

As also will be seen from viewing FIG. 6, the mounting brackets can be reversed and turned backwards as shown in phantom, thereby extending the width of the chair between the main wheels an amount equal to the width of the two wheel brackets.

It will also be appreciated that the brackets may be inverted, that is, turned over such that the dual row of bores shown at the top in FIG. 4 will be at the bottom and the single row at the top. With this arrangement, additional mounting positions for the wheel are provided. Thus, multiple different wheel positions for the main wheels are selectable simply by selecting the various bores within the brackets and in addition by inverting the bracket such that additional positions are provided or presented by the bores.

As will be seen from FIG. 2, the wheel chair includes a pair of identical main wheels 94 and 96, each including a hand rim 98 and 100 respectively. These wheels are selectable and in diameter. size and weight but are preferably of the type utilized on lightweight racing bikes. The wheels are each detachably connected by quick detach axle assembly as best seen in FIG. 5.

Each of the wheels is mounted on an axle 102 by means of the usual bearing assembly appropriately secured and adjustably mounted thereon. Each of the axles 102 includes a releasing detent mechanism of a known pin type such as available from Lockwell Products Co., Division of Hartwell Corporation located in Azusa, Calif., catalog part number LG(3-16L), including detent balls 104 at the inner end thereof and a releasing pin or plunger 106 at the outer end thereof which extends through a central bore in the axle 102 for releasing the detent ball to 104. An adjustable nut 108 threadably mounted on the outer end of the axle 102 adjusts the axial tension and slack in the axle 102 by adjusting the axial tension and slack in the axle 102 by adjusting the distance between the nut 108 and the detents 104. This provides means for adjustably positioning the detents for a firm and secure retaining of the axle and wheel assembly in position.

The wheel is removed from the frame assembly simply by pressing the plunger 106, releasing detents 104 and thereby the axle assembly from its mounted position. Thus, a quick detachment of the wheels is provided. Adjustment of the position of the nut 108 is accomplished by means of a special wrench device 110 which extends over the end of the axle 102 for engaging the detent members 104. This permits a wrench to be used for turning nut 108 and adjusting the proper length of the axle 102.

A pair of caster wheels 112 and 114 are respectively mounted in a pair of forks 116 and 118 each of which includes a vertical spindle mounted in bearings or bushings in the castor mounting brackets 56 and 58.

As best seen in FIG. 3, the caster assembly 118 includes a vertically extending shank 120 extending beyond the upper end of the mount 58 and secured into position by a tensioning nut 121 threadably engaging the stem 120. A steering arm 122 adjustably secured to the upper end of the mounting shank 120 by means of a bolt or the like 124. The steering arm 122 is secured to a sleeve 126 which is mounted on the upper end of shank 120 and secured in position by the bolt 124. The steering arm 122 may be selectively positioned in any desirable angle with respect to the wheels to permit the steering of the wheel chair for high speed racing and the like.

Turning back to FIG. 4, a seat arrangement or assembly for the chair is illustrated. The seat assembly includes a lower or bottom portion 128 which comprises a generally rectangular sheet of suitable fabric material secured as best as seen in FIG. 2 along each side to the upper tubular members 16 and 18 of the side frames. The back rest includes a lower panel 130 generally rectangular configuration and an upper panel 132 having tubular portions 134 and 136 at each side thereof. The back panel 132 extends between the vertical tubular member 60 and 62 of the back frame and the tubular portions 134 and 136 are telescopically received on the tubular members. The lower panel 130 overlaps the seat panel 128 and preferably includes strips 138 of hook and loop fastener means that cooperate with corresponding opposing hook and loop strips 140 on the seat panel 128. With this arrangement, the entire frame assembly etc. can be taken apart and put together in a matter of just a few moments. Similarly, the back can be adjusted in height with respect to the seat and other adjustments can be made such as adjustment of the pocket area between the back rest 132 and seat 128.

The wheel chair assembly is preferably made of the lightweight strong stainless steel tubing welded for high strength. The entire assembly can be broken down, as can be seen in FIG. 4, into four major frame or body components with the wheels completely separated therefrom. This arrangement permits the entire wheel chair to be broken down and placed within a bag and quickly and easily transported.

The wheels as previously described include a hand rim which as will be seen in FIG. 1 is connected to the wheel by a plurality of brackets 142. These brackets each are in a generally V shape having the apex portion thereof, connected directly to the rim 100 by means of spacers as can be seen in FIG. 2 and the outer ends of the V bar connected to the brackets on the rim of the wheel. The spacings between the outer ends of the V brackets are selected to be positioned between the spokes of the wheel. With this arrangement, as illustrated a high torque can be imposed on the wheel and will be transmitted rather uniformily thereto.

While I have illustrated and described my invention by means of specific embodiments, it is to be understood that major changes and modifications may be made therein without departing from the spirit and scope of the invention as defined in the appended claims. For example, other types of quick release pins or fasteners can be utilized.

I claim:

1. A quick breakdown wheel chair assembly comprising a pair of side frames, a front frame telescopically engaging said side frames for adjusting the length of the chair assembly including quick release pins for detachably connecting said side frames together at the front thereof and a back frame including quick release pin means for detachably connecting said side frames together at the back end thereof, wherein said front frame has a generally A configuration with a forward foot bar and an intermediate leg support bar, and a pair of castors mounted at the ends of said leg support bar.

2. The wheel chair assembly of claim 1 wherein each of said side frames includes a wheel bracket for detachably mounting a wheel, said wheel bracket having a plurality of axle mounting bores.

3. The wheel chair assembly of claim 2 including a pair of main wheels, each of said main wheels rotatably mounted on an axle shaft, said shaft includes a quick release shank for extending into and releasably mounting in selected ones of said bores in said wheel bracket.

4. The wheel chair assembly of claim 3 wherein said axle includes a co-axial bore and releasing pin extending along said bore and engageable at the outer end thereof for releasing said axle from the mounting bore.

5. The wheel chair assembly of claim 1 wherein said side frames each comprise an upper and a lower tubular member connected together by a pair of vertical tubular members, said upper and lower tubular members extending generally parallel at the back end thereof between the connection of said vertical tubular members and converge together at the front end thereof.

6. The wheel chair assembly of claim 1 including a main wheel detachably secured to each of said side frames.

7. The wheel chair assembly of claim 1 wherein said side frames each comprise an upper and a lower tubular member connected together by a pair of vertical tubular members, said upper and lower tubular members extend generally parallel at the back end thereof between the connection of said vertical tubular members and converge together at the front end thereof, each of said side frames includes a wheel bracket for detachably mounting a wheel, said wheel bracket having a plurality of axle mounting bores, and a pair of main wheels, each of said main wheels rotatably mounted on an axle shaft, said shaft includes a quick release shack for extending into and releasably mounting in selected ones of said bores in said wheel bracket.

8. A quick breakdown wheel chair assembly comprising a pair of side frames, a front frame telescopically engaging said side frames for adjusting the length of the chair assembly including quick release pins for detachably connecting said side frames together at the front thereof and a back frame including quick release pin means for detachably connecting said side frames together at the back end thereof, wherein said front frame has a generally A configuration with a forward foot bar and an intermediate leg support bar, and a pair of castors mounted at the ends of said leg support bar, and said front frame is invertible with respect to said side frames and said castors for adjusting the height of said frame.

9. A quick breakdown wheel chair assembly comprising a pair of side frames, a front frame including quick release pins for detachably connecting said side frames together at the front thereof and a back frame including quick release pin means for detachably connecting said side frames together at the back end thereof, said side frames each include a pair of C brackets for receiving said back frame.

10. The wheel chair assembly of claim 9 wherein said quick release pins extend through said C brackets.

11. The wheel chair assemblly of claim 10 wherein said back frame is adjustable in height with respect to said side frames.

12. The wheel chair assembly of claim 9 wherein said front frame telescopically engages said side frames for adjusting the length of the frame assembly.

13. The wheel chair assembly of claim 12 wherein said front frame includes a caster mounted on each side thereof.

14. The wheel chair assembly of claim 9 wherein each of said side frames includes a wheel bracket for detachably mounting a wheel, said wheel bracket having a plurality of axle mounting bores.

15. The wheel chair assembly of claim 14 including a pair of main wheels, each of said main wheels rotatably mounted on an axle shaft, said shaft includes a quick release shank for extending into and releasably mounting in selected ones of said bores in said wheel bracket.

16. The wheel chair assembly of claim 15 wherein said axle includes a coaxial bore and releasing pin extending along said bore and engageable at the outer end thereof or releasing said axle from the mounting bore.

17. The wheel chair assembly of claim 15 wherein said wheel bracket includes adjusting means for selectively adjusting the camber of said wheel.

18. The wheel chair assembly of claim 15 wherein said wheel bracket is selectively reversible for selectively adjusting the width between said wheels.

19. A quick breakdown chair assembly comprising a pair of side frames, a front frame including quick release pins for detachably connecting said side frames together at the front thereof and a back frame including quick release pin means for detachably connecting said side frames together at the back end thereof, each of said side frames includes a wheel bracket for detachably mounting a wheel, said wheel bracket having a plurality of axle mounting bores, a pair of main wheels, each of said main wheel rotatably mounted on an axle shaft, said shaft includes a quick release shank for extending into and releasably mounting in selected ones of said bores in said wheel bracket, and said wheel bracket includes adjusting means for selectively adjusting the camber of said wheel.

20. A quick breakdown chair assembly comprising a pair of side frames, a front frame including quick release pins for detachably connecting said side frames together at the front thereof and a back frame including quick release pin means for detachably connecting said side frames together at the back end thereof, each of said side frames includes a wheel bracket for detachably mounting a wheel, said wheel bracket having a plurality of axle mounting bores, a pair of main wheels, each of said main wheels rotatably mounted on an axle shaft, said shaft includes a quick release shank for extending into and releasably mounting in selected ones of said bores in said wheel bracket, and said wheel bracket is selectively reversible for selectively adjusting the width between said wheels.

21. A quick breakdown chair assembly comprising a pair of side frames, a front frame including quick release pins for detachably connecting said side frames together at the front thereof and a back frame including quick release pin means for detachably connecting said side frames together at the back end thereof, each of said side frames includes a wheel bracket for detachably mounting a wheel, said wheel bracket having a plurality of axle mounting bores, a pair of main wheels, each of said main wheels rotatably mounted on an axle shaft, said shaft includes a quick release shank for extending into and releasably mounting in selected ones of said bores in said wheel bracket, and said wheel bracket is reversible for selectively increasing the positions of adjustments of said frame relative to said wheels.

22. A quick breakdown chair assembly comprising a pair of side frames, a front frame including quick release pins for detachably connecting said side frames together at the front thereof and a back frame including quick release pin means for detachably connecting said side frames together at the back end thereof, said side frames each comprise an upper and a lower tubular member connected toegther by a pair of vertical tubular members, said upper and lower tubular members extend generally parallel at the back end thereof between the connection of said vertical tubular members and converge together at the front end thereof, and seat means comprising a first generally rectangular panel of fabric material secured along opposite sides to said upper tubular member of said side frames, and a back rest including a top portion detachably securable to said back frame, and a bottom portion detachably securable to said first panel.

23. The wheel chair assembly of claim 22 wherein said top portion of said back rest includes tubular pockets extending along opposite sides thereof for telescopically receiving a pair of upstanding tubular member of said back frame.

24. The wheel chair assembly of claim 22 wherein said bottom portion is detachably securable to said first panel by means of hook and loop fastening.

* * * * *